United States Patent [19]

Weathers

[11] Patent Number: 4,949,850

[45] Date of Patent: Aug. 21, 1990

[54] SELF-STORING WRITING INSTRUMENT HOLDER FOR CABINETS

[75] Inventor: James E. Weathers, Fruitport, Mich.

[73] Assignee: Grabman Associates, Grand Haven, Mich.

[21] Appl. No.: 346,923

[22] Filed: May 3, 1989

[51] Int. Cl.[5] ..... A47F 7/00

[52] U.S. Cl. ..... 211/69.7; 24/11 C; 312/248; 312/310

[58] Field of Search ..... 211/69.5, 69.7, 69.6, 211/69.8, 69.1; 24/11 C, 11 CC, 11 F, 10 R; 312/233, 120, 123, 248, 319, 310, 315, 316, 295, 314, 313

[56] References Cited

U.S. PATENT DOCUMENTS

| | | | |
|---|---|---|---|
| D. 192,031 | 1/1962 | Kowalczyk . | |
| D. 255,251 | 6/1980 | Hansen et al. . | |
| D. 261,903 | 11/1981 | Mulder . | |
| 707,546 | 8/1902 | Brooke . | |
| 935,393 | 9/1909 | Myers | 24/11 C |
| 1,162,732 | 11/1915 | Draeger | 24/11 C |
| 1,453,943 | 5/1923 | Mitchell | 312/248 |
| 1,675,543 | 7/1928 | Fremon et al. | 211/69.8 |
| 1,719,840 | 7/1929 | Horix . | |
| 1,804,871 | 5/1931 | Helland | 312/315 |
| 2,307,511 | 1/1943 | Johnson | 211/69.4 |
| 2,358,041 | 9/1944 | Williams | 312/310 |
| 2,583,567 | 1/1952 | Hansen . | |
| 2,890,090 | 6/1959 | Olson | 211/69.7 |
| 2,907,584 | 10/1959 | Neilsen . | |
| 3,193,341 | 7/1965 | Preston . | |
| 3,227,472 | 1/1966 | Swift . | |
| 3,953,092 | 4/1976 | Cronan et al. . | |
| 3,977,744 | 8/1976 | DeWitt . | |
| 4,053,133 | 10/1977 | Kauffman . | |
| 4,241,963 | 12/1980 | Seidel | 312/313 |
| 4,366,999 | 1/1983 | Konclik et al. . | |
| 4,375,296 | 3/1983 | Chang . | |
| 4,445,728 | 5/1984 | Bratton . | |
| 4,453,788 | 6/1984 | Russell . | |
| 4,603,883 | 8/1986 | Barbieri et al. . | |
| 4,669,617 | 6/1987 | Boeckmann et al. . | |
| 4,740,044 | 4/1988 | Taylor | 312/310 |
| 4,745,163 | 2/1987 | Zovar . | |
| 4,766,881 | 8/1988 | Pax | 312/248 |

*Primary Examiner*—Kenneth J. Dorner
*Assistant Examiner*—Gerald A. Anderson
*Attorney, Agent, or Firm*—Price, Heneveld, Cooper, DeWitt & Litton

[57] ABSTRACT

A cabinet is disclosed which is adapted to be mounted in a vertical plane. Mounted on an inside sidewall of the cabinet adjacent the opening edge is a base plate having a flat portion which fastens to the wall and turned upper and lower edges which function as stops. A pedestal is mounted for rotation on the base plate and has stops which act with the stops on the base plate to determine a first and second position for the pedestal. A writing instrument support is mounted on the pedestal and moves with the pedestal to a first position where the writing instrument is stored within the cabinet and then to a second position to which it freely falls under the pull of gravity when the cabinet door is opened. The combined cabinet and writing instrument holder provide a convenient means of storing records upon which data is to be recorded along with a convenient holder for a writing instrument which drops into a position where the writing instrument can be easily grasped by the record keeper when data has to be recorded on the stored documents.

13 Claims, 2 Drawing Sheets

SELF-STORING WRITING INSTRUMENT HOLDER FOR CABINETS

BACKGROUND OF THE INVENTION

In a modern factory, data is often collected with regard to both the quantity and quality of the parts being produced. This is particularly important if computerized records are maintained. At the present time, this data is usually recorded on a workstand which is subject to having dust and debris deposited on the papers upon which the data is to be collected. This is clearly an undesirable situation. The combination cabinet and writing instrument holder of the present invention is particularly adapted for use in such harsh environments. The cabinet provides a closed workspace which is only opened when data is to be recorded on the stored stationery. The writing instrument holder is mounted in the cabinet so that it can fall freely into position for the record taker to reach the writing instrument when data is to be recorded. When finished, the cabinet is closed automatically restoring the writing instrument and protecting the documents from damage.

In the prior art, it is known to provide writing instrument holders which are spring-loaded; for example, U.S. Pat. No. 2,907,584, patented October 6, 1959, to H. L. Neilsen, discloses a coil spring for moving a pencil holder away from the cover of a memorandum pad holder. Also, numerous references are available in the prior art showing writing instruments clipped either to the cover or within the body of a document holder where they can be grasped after the document holder is opened. No reference has been found which discloses a cabinet containing a writing instrument support which falls freely into place by the mere opening of the cabinet and which provides a protected environment for the documents upon which data is to be collected.

SUMMARY OF THE INVENTION

In accordance with the present invention, a cabinet having a self-storing writing instrument is disclosed. The cabinet is adapted to be mounted in a generally vertical plane. The cabinet has a back, vertical side walls extending from each side of the back, and a front pivoted from either one side or from the bottom and adapted to close the cabinet. The writing instrument holder has a base adapted to be fastened to a vertical side wall of the cabinet. The base provides a guiding surface upon which a pedestal is adapted to rotate. The base and pedestal are both equipped with stops to limit the movement of the pedestal. The base and pedestal are joined together by a fastener which, while holding the two pieces together, enables them to rotate relative to one another. A writing instrument holder is fastened to the pedestal and is adapted to move under the pull of gravity from a first position to a second position when the cabinet is opened. In the first position, the writing instrument is stored within the cabinet while in the second position, the writing instrument drops to become freely accessible to the person needing to use the writing instrument.

BRIEF DESCRIPTION OF THE DRAWINGS

For a more complete understanding of the present invention and the advantages thereof, reference is now made to the following description taken in conjunction with the accompanying drawings in which.

DESCRIPTION OF A PREFERRED EMBODIMENT

Figure 1:
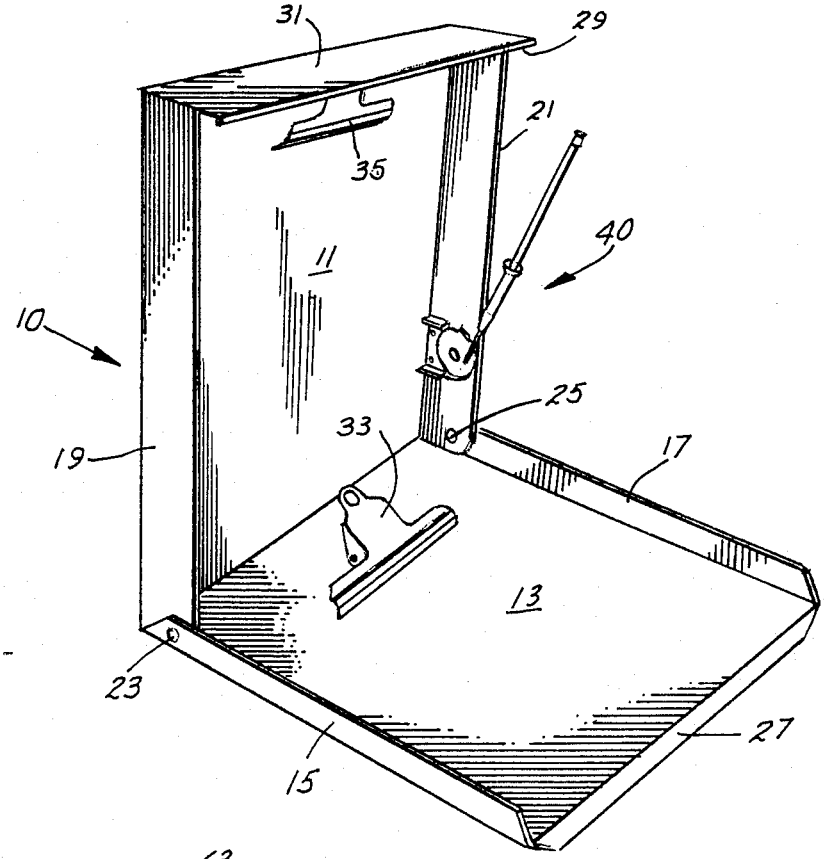
FIG. 1 is a perspective view of an open cabinet showing a writing instrument holder containing a pencil in its lower position.

Referring to FIG. 1, a cabinet 10 is shown having a back 11, a front 13 having turned edges 15 and 17 which are joined to the sides 19 and 21 by fasteners 23 and 25 which enable the front 13 to pivot upward to a closed condition. The front 13 has a turned down edge portion 27 which cooperates with the turned in edge portion 29 on the cabinet top 31 to hold the front 13 in a closed position. The front 13 has a clip 33 for holding stationery or documents on which information is to be recorded. The back 11 has a similar clip 35 mounted near its top also adapted to support stationery or records. A writing instrument holder 40 is shown fastened to the inside of cabinet side 21.

Figure 2:
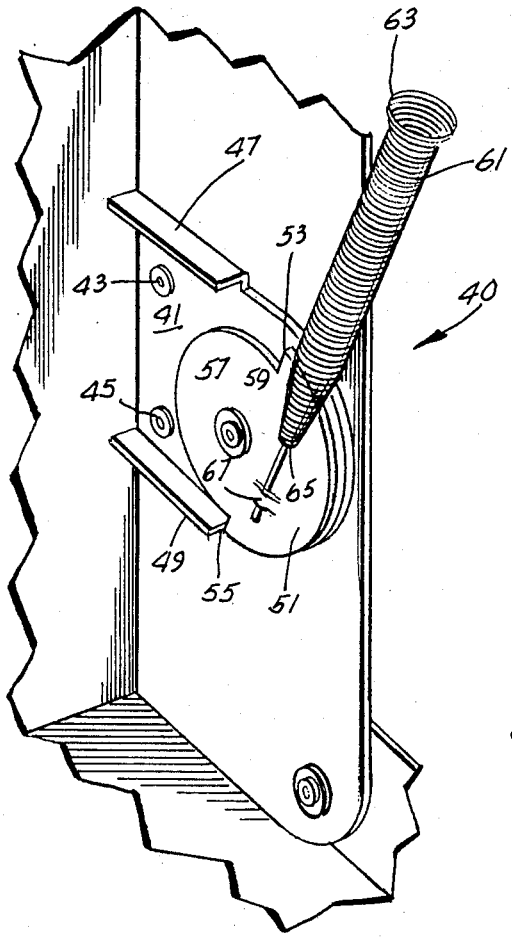
FIG. 2 is a fragmentary view of the cabinet of FIG. 1 showing the writing instrument holder in greater detail.

The writing instrument holder 40 is shown in greater detail in FIG. 2. The term "writing instrument" is meant to include a pencil, a pen, or any other device which a person might use to make a record on a document. The writing instrument holder 40 has a base 41 for fastening to the generally vertical sidewall of a cabinet which can be made of any suitable material such as metal, plastic, or wood. The base is fastened to the side wall by screws, rivets, or any other suitable means 43 and 45. As shown in FIG. 2, the base 41 has an upper turned in edge 47 and a lower turned-in edge 49, the leading edges of which function as stops for the pedestal 51. The pedestal 51 is of a substantially circular configuration and can be described as being formed from portions of two circles of different radii. The projections of the larger circle beyond the smaller circle form stops 53 and 55 which cooperate with the turned in edges 47 and 49 on base 41 to limit the rotation of pedestal 51. Pedestal 51 is joined to base 41 by a fastener 57. Many different types of fasteners can be used to join the base and pedestal. For example, a nut and bolt, a sheet metal screw, or preferably a rivet can be used to join the two pieces. It is only essential that the fastener allow the pedestal 51 to rotate relative to the base 41. In the embodiment of the writing instrument holder illustrated in FIGS. 2 and 4, the center portion 59 of the pedestal is raised as is the mating portion of the base 41 to enable the base 41 to be fastened flush with the inner wall of the cabinet. The raised portion also supports the fastener away from the cabinet surface to prevent the fastener from binding and in turn preventing the pedestal 51 from rotating.

As shown in FIG. 2, the writing instrument holder 61 is prepared from a tightly wound steel wire which provides some flexibility to the body of the holder. The top of the holder is flared outward at 63 to facilitate the entry of the writing instrument. At the opposite end 65, the wire spiral is not closed completely but is left open to provide room for the point of the writing instrument to project outwardly and to enable dirt or debris to fall freely from the holder. The spiral spring-like holder is fastened to the pedestal 51 by inserting a straightened portion of the steel wire through a raised cutout 67 in the pedestal 51. After the wire is passed through the raised portion, the portion is rolled or pressed against the wire to firmly lock the writing instrument holder in place on the pedestal. While in the preferred embodiment the writing instrument for example a pencil holder is made from a tightly wound steel wire, it can also be made in other configurations from a metal or plastic. For example, a molded plastic sleeve could have a steel pin inserted near its open end for insertion into the raised portion 67 to support the holder on the pedestal 51. The base 41 and pedestal 51 are preferably made of steel which can be plated with a bright chromium, nickel or other finish to avoid corrosion. These same parts can also be made from other materials if the conditions of use allow, for example, stainless steel, aluminum alloys and plastic materials can be used.

Figure 3:
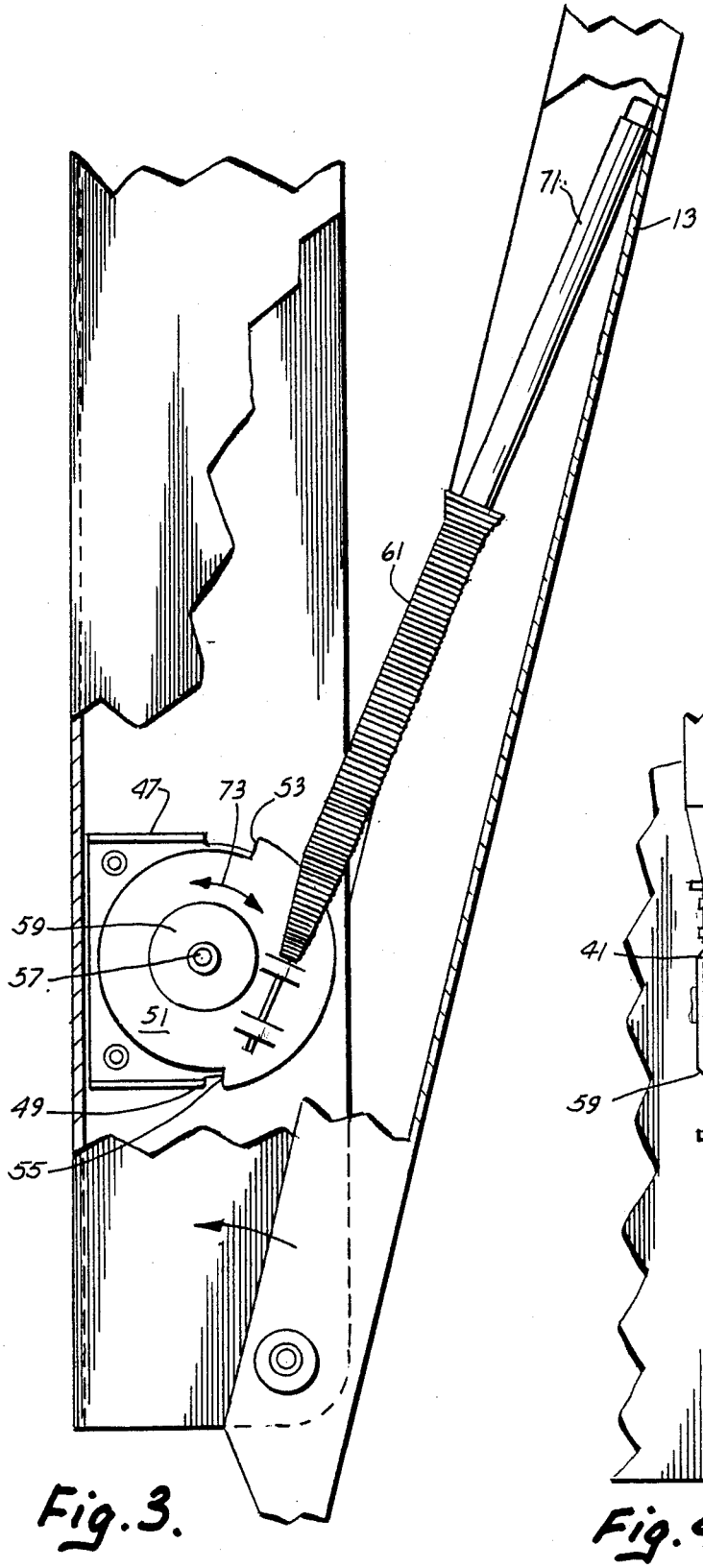
FIG. 3 is a view, partially in section, showing a cabinet door in with a writing instrument.

Now referring to FIG. 3, a writing instrument 71 is shown in position in the holder 61. In using the cabinet and writing instrument holder of the present invention, as one lowers the door 13, the pencil 71 and writing instrument holder 61 will fall away from the cabinet under the pull of gravity until the stop 55 abuts the edge of the turned surface 49. The writing instrument holder moves approximately 15° in its travel from the stored to the cabinet open position. The arrow 73 shown on the pedestal 51 is intended to indicate that the pedestal can freely rotate in either direction about the fastener 57. In order to ensure a free fall of the writing instrument holder, the holder 61 is fastened to the outer circular portion of pedestal 51 so that its weight is to the outside of the fastener or pivot point 57. When the writing instrument 71 is raised by the lid 13, the pedestal 51 will rotate until stop 53 contacts turned edge 47 on base 41. Continued closure of the lid 13 will not cause the writing instrument 71 and the holder 61 to be pushed over center of the fastener 57. The offset mounting of the holder 61 and writing instrument 71 ensure that on opening of the door 13, the pedestal 51 will rotate dropping the writing instrument into position to be readily grasped by the record keeper. To make the writing instrument even more accessible to the person needing it, the holder 61 can be bent away from the pedestal 51, that is, away from the sidewall of the cabinet, so that the writing instrument points in the direction of the person when it falls into place.

Figure 4:
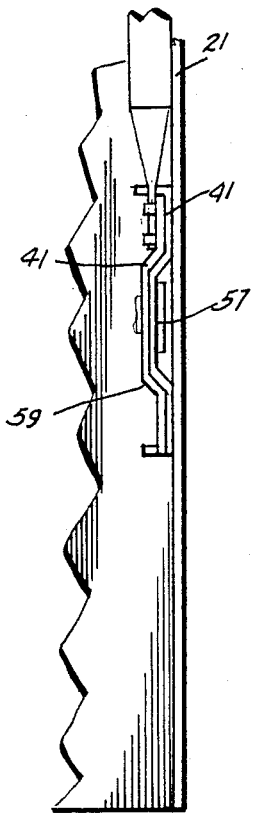
FIG. 4 is a sectional view showing a method of joining the base and pedestal of the writing instrument holder.
Figure 5:
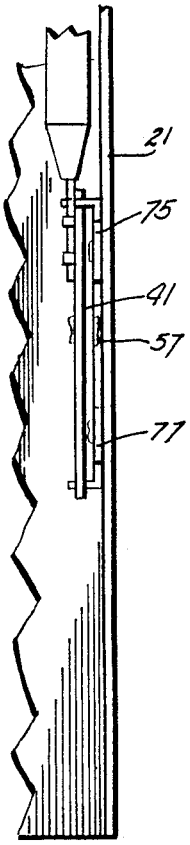
FIG. 5 is a sectional view showing another method of joining the base and pedestal of the writing instrument holder.

FIG. 4 shows the base of the writing instrument holder 41 positioned against the side wall 21 of the cabinet. The fastener 57 is in the center of the raised portion 59 of the pedestal 51 and the corresponding portion of the base 41. The portion of the fastener between the writing instrument holder and the side wall of the cabinet is clearly separated from the cabinet to prevent any possibility of binding which would limit or obstruct the free fall of the writing instrument holder. While this is the preferred mode of fastening the writing instrument holder to the cabinet, FIG. 5 shows another embodiment in which spacers 75 and 77 are positioned underneath the base 41 to provide room for the fastener 57 to rotate without contacting the side 21 of the cabinet.

It is important to note in the operation of the writing instrument holder of the present invention, that no spring or biasing means is used to move the holder from its stored to its working position. The parts of the writing instrument holder are assembled so that the mass of the holder is offset from the pivot point to ensure the drop of the holder when the cabinet door is open. Likewise, when the cabinet door is closed, there is no spring or other bias means to be overcome to return the writing instrument holder to its stored condition. The door can merely be raised or swung in to contact the writing instrument or holder, and the holder will move back freely into place.

Though the invention has been described with respect to specific preferred embodiments thereof, many variations and modifications will immediately become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A cabinet having a self-storing writing instrument holder comprising:

a cabinet for mounting in a generally vertical plane and having a back, vertical sidewalls extending from each side of the said back, a top extending from said back and joining said sidewalls and a front pivotally secured to each of said vertical sidewalls and able to swing upwardly to contact said top to close said cabinet;

a base for attachment to one of said vertical sidewalls of said cabinet and having upper and lower stops;

a pedestal mounted for rotation about a pivot point on said base and having rotation-limiting stops which contact the stops on said base;

a fastener for joining said base and said pedestal while enabling said pedestal to rotate relative to said base;

a writing instrument holder on said pedestal and adapted to move with said pedestal under the pull of gravity from a first to a second position when the writing instrument holder is released by the opening of said cabinet.

2. A cabinet having a self-storing writing instrument holder as set forth in claim 1 wherein both said base and said pedestal have raised portions at the pivot point to hold said fastener away from said vertical sidewall and to provide a substantially matching mating surfaces.

3. A cabinet having a self-storing writing instrument holder as set forth in claim 1 wherein both said base and said pedestal have substantially flat mating surfaces and a spacer is used between said base and one of said vertical sidewalls of said cabinet to allow rotation of said pedestal and said fastener.

4. A cabinet having a self-storing writing instrument holder as set forth in claim 1 wherein the first and second positions of the writing instrument holder are determined by said stops on said base and said pedestal.

5. A cabinet having a self-storing writing instrument holder as set forth in claim 1 wherein the first stop for said writing instrument holder is the stored position where the writing instrument is prevented from rotating over the center of said pivot point between said base and said pedestal to ensure a free fall under the pull of gravity when said cabinet is opened.

6. A cabinet having a self-storing writing instrument holder as set forth in claim 1 wherein the second stop for said writing instrument holder is the working position to which said writing instrument holder freely falls upon opening said cabinet.

7. A cabinet having a self-storing writing instrument holder as set forth in claim 6 wherein said writing instrument holder moves approximately 15° when it falls under the pull of gravity from its first stored position to its second working position.

8. A cabinet having a self-storing writing instrument holder as set forth in claim 6 wherein said writing instrument holder is a closely wound elongated spring having a substantially cone-shaped portion for holding the writing end of a writing instrument and an elongated tubular-shaped portion for holding the barrel of the writing instrument.

9. A cabinet having a self-storing writing instrument holder as set forth in claim 8 wherein the cone-shaped portion has an open end to allow the tip of the writing instrument to project through and to facilitate cleaning of the writing instrument holder.

10. A cabinet having a self-storing writing instrument holder as set forth in claim 8 wherein said writing instrument holder is mounted at an angle relative to the surface of said pedestal so that the end of the writing instrument will point toward the user to facilitate gripping of the writing instrument after said writing instrument holder has freely fallen into place.

11. A self-storing writing instrument holder for a cabinet comprising:

a base having left and right portions for attachment to a vertical sidewall of a cabinet, the left portion of said base having upper and lower turned-in edges which are adapted to act as stops, the right portion, extending beyond the turned-in edges, has a pivot hole centrally located relative to the top and bottom edges of the base and a surface extending to the right bounded by a substantially circular line extending from the upper turned-in edge to the lower turned-in edge which functions as a guide surface;

a pedestal having a pivot hole for alignment with the pivot hole in said base, and adapted to rotate about the right portion of said base, said pedestal having a substantially circular overall configuration made up of portions of two circles of different radii with the beginning and ending edges of the larger circular portion cooperating with the turned-in edges on said base to limit the rotation of said pedestal relative to said base;

a fastener for joining said base and said pedestal while allowing said base and pedestal to rotate relative to one another;

a writing instrument holder fastened to the larger circular portion of said pedestal and adapted to fall by gravity when the door of a cabinet is opened.

12. A self-storing writing instrument holder as set forth in claim 11 wherein said writing instrument holder is made from a substantially elongated closely wound wire spring.

13. A stationery storage cabinet with a self-storing writing instrument holder, comprising:

a cabinet chassis shaped to store stationery articles and the like therein, and including an open doorway through which the stationery articles are passed;

a cabinet door shaped to selectively close the doorway of said cabinet, and movably connected with said cabinet chassis for movement between an open position and a closed position, said cabinet door providing a writing surface when in said open position;

a holder having one portion thereof movably connected with said cabinet chassis, and another portion thereof shaped to removably retain a writing instrument or the like therein;

means for connecting said holder on said cabinet chassis for movement between a retracted position wherein said holder and any associated writing instrument are disposed wholly within said cabinet chassis, and an extended position wherein at least a portion of one of said holder and any associated writing instrument protrudes outward from said cabinet chassis; said holder being positioned in such proximity to said cabinet door so that as said cabinet door is opened to provide a writing surface, said holder and any associated writing instrument automatically shift under gravitational forces from the retracted position to the extended position to facilitate grasping of any writing instrument and removing the same from said holder, and as said cabinet door is closed, at least one of said holder and associated writing instrument is abuttingly engaged by said cabinet door and thereby shifted from the extended position to the retracted position for safe storage.

* * * * *